US005562341A

United States Patent [19]

Strauss

[11] Patent Number: 5,562,341

[45] Date of Patent: Oct. 8, 1996

[54] MODULAR ELECTRICAL FIXTURE

[76] Inventor: Gary J. Strauss, 8 Dunham Dr., New Fairfield, Conn. 06812

[21] Appl. No.: 458,708

[22] Filed: Jun. 2, 1995

Related U.S. Application Data

[63] Continuation-in-part of Ser. No. 203,550, Mar. 1, 1994.

[51] Int. Cl.[6] ..... H01R 33/00

[52] U.S. Cl. ..... 362/226; 439/378; 439/535; 439/536

[58] Field of Search ..... 362/226; 439/535, 439/536, 537, 378, 379

[56] References Cited

U.S. PATENT DOCUMENTS

| | | | |
|---|---|---|---|
| 1,376,712 | 5/1921 | Liebold | 439/536 |
| 1,636,278 | 7/1927 | Benjamin | 439/313 |

*Primary Examiner*—Carroll Dority

[57] ABSTRACT

A modular system is provided that has a fixture that will accept substantially any electrical device and can be plugged into any one of a plurality of fixture supports, and similarly unplugged, to permit removal, replacement, and/or reorientation with relative ease to obtain any desired configuration of electrical devices without the need for repeated rewiring.

15 Claims, 3 Drawing Sheets

MODULAR ELECTRICAL FIXTURE

This application is a continuation-in-part of application 203,550, filed Mar. 1, 1994.

FIELD OF THE INVENTION

The invention described herein relates to a novel electrical fixture for both indoor and outdoor use. The fixture is designed to accept substantially any electrical device and to permit removal, replacement and/or reorientation with relative ease to obtain any desired configuration of electrical devices without the need for repeated rewiring.

BACKGROUND OF THE INVENTION

Electrical devices such as lighting fixtures are commonly mounted on interior or exterior surfaces with what is known in the electrical trade as an outlet box. Outlet boxes are adapted to receive electrical cable and an outlet cover. They are typically mounted either flush with or recessed within a wall, ceiling or floor.

On an interior wall, for example, electrical cable carrying house current, usually installed previously within the wall, is clamped to an outlet box which is then recessed within and rigidly mounted to the wall. One or more electrical devices are then mounted to an outlet cover. After wiring the device to the electrical cable inside the outlet box, the outlet cover is mounted on the outlet box, thus affixing the connected electrical device(s) to the interior wall.

Electrical devices are typically installed on exterior surfaces in a similar manner although the outlet box is usually not recessed, but is instead mounted flush with the surface on which it is mounted. In this case, a relatively small hole is usually drilled into the wall to permit the cable to pass into the outlet box. Cables may also be carried along the outside of the wall to the outlet box via steel pipes.

Although the use of the outlet box for mounting electrical devices in this way is almost universal in the electrical trade, its use poses several problems. Because the electrical devices mounted to the outlet cover are connected directly to the house wiring within the outlet box, modification or exchange of the devices after initial installation involves the time consuming process of disconnecting the old devices and reconnecting the new. Additionally, because the electrical devices must be wired to potentially live wiring within the outlet box before the outlet cover can be mounted to it, a shock hazard exists during installation and every time the fixture is modified or exchanged.

Mounting electrical devices in exterior locations using an outlet box presents significant additional difficulties. Because they are directly exposed to weather conditions, exterior electrical fixtures must be relatively weatherproof. Although weatherproof outlet boxes are common in the electrical trade, holes drilled to accommodate wiring, for example, must be sealed with silicone rubber or a similar substance to completely weatherproof the installation thereby adding time and inconvenience to the process.

Furthermore, as considerations of convenience and security call more and more frequently for remotely switched lighting, there is a need for a system that may easily incorporate a variety of remote electrical switches and to protect them from weather and tampering.

For the foregoing reasons, there is a need for a novel system to mount substantially any electrical device in indoor and outdoor locations with relative ease and to permit removal, replacement and/or reorientation without the need for repeated rewiring.

SUMMARY OF THE INVENTION

It is therefore an object of the present invention to provide a modular system, to which light fixtures and similar electrical devices may be mounted, in which individual devices can be added, removed, replaced and/or reoriented with relative ease to obtain any desired configuration of electrical devices.

A further object of the present invention is to provide a modular system, to which light fixtures and similar electrical devices can be electrically connected, in which individual devices can be removed and replaced without repeated rewiring.

A further object of the present invention is to provide a modular system of the type described herein which is suitable for mounting on substantially any interior or exterior surface or staked into the ground.

A further object of the present invention is to provide a system for mounting electrical devices that will easily incorporate an electrical switch, either remotely or locally actuated, and protect the switch from weather and tampering.

The present invention resolves the difficulties encountered in the prior art as described above by substantially replacing the outlet box with a modular fixture support which is adapted to closely receive and mate with a modular fixture. Electrical devices are mounted to the modular fixture and are wired to an electrical connector on the modular fixture. The modular fixture support has an electrical connector that mates with the connector on the modular fixture. The modular fixture support is mounted to an interior or exterior surface such as a wall and is wired from its electrical connector to an external power source such as house current. The modular fixture is simply plugged or unplugged as required into any one of a plurality of corresponding fixture supports, thereby securing and powering the electrical devices mounted on the fixture.

DETAILED DESCRIPTION OF THE PREFERRED EMBODIMENTS

Figure 1:
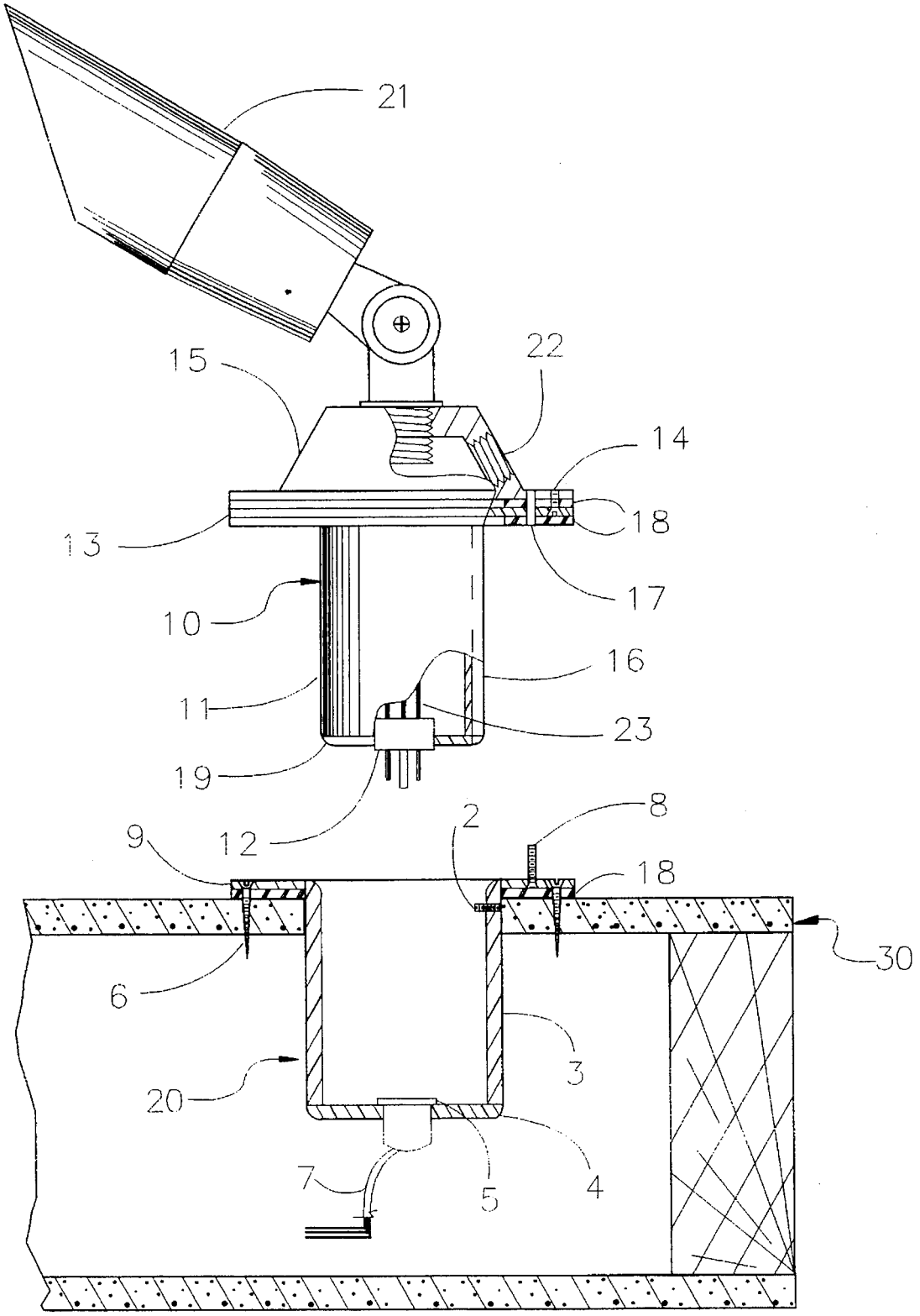
FIG. 1 is a section view of a modular fixture constructed according to a first embodiment of the present invention and mounted within a wall.

Referring now to the drawings wherein like reference numerals are used to designate like parts, and according to FIG. 1, the modular system comprises, from front to back, modular fixture 10, and modular fixture support 20. Electrical devices which may be used with the modular system include incandescent and inductive light sources and security equipment such as motion sensors and cameras. It will be recognized, however that any electrical device currently capable of being mounted indoors or outdoors is appropriate for mounting with the modular system.

As used herein, the terms "front" and "frontwardly", when applied to the modular system of the invention, refer to that portion of the invention to which electrical devices are mounted. Alternately, the opposed portion or direction is referred to herein as the "rear" or "back" of the modular system.

In FIG. 1 there is illustrated a section view of the modular system. The modular fixture 10 comprises a hollow trunk 11, front portion of which is furnished with a flange 13 adapted to receive an outlet cover 15, said cover being secured to the front of trunk 11, through holes defined by flange 13, by fasteners 14. Electrical connector plug 12 is mounted on the rear of trunk 10 with plug contact facing the rear of the fixture.

The fixture support 20 comprises a hollow trunk 3, front portion of which is furnished with a flange 9. Electrical connector plug 5, adapted to mate with connector plug 12, is mounted on the rear of trunk 3 with the plug contact facing frontwardly.

Trunks 11 and 3 may be made of any material durable enough to support the electrical devices mounted to outlet cover 15 and to withstand repeated removal and replacement of modular fixture. Schedule 40 PVC pipe is suitable for most household and light industrial applications. The diameter of trunk 11 must be adequate to allow wiring to pass from devices mounted to the front of the fixture to plug 12. 2 inches is suitable for most purposes.

The inner diameter of trunk 3 must be sufficient to receive trunk 11. Where trunk 11 is made of 2 inch schedule 40 PVC pipe, 2 ½ inch schedule 40 PVC pipe is suitable for trunk 3. Plug 5 is aligned so that when rear of modular fixture 10 is inserted into modular fixture support 20, plug 12 will mate with plug 5, establishing electrical contact therewith. To ensure contact between plugs 12 and 5, trunk 11 must be long enough, from front to rear, to permit mating of plugs 12 and 5 when fixture 10 is inserted into support 20.

Plugs 12 and 5 may be any matching pair of (i.e. male and female) electrical connectors. Standard "three-prong" connectors are suitable for most household and light industrial applications. Caps 19 and 4 may also be made of PVC material and are mounted at the rear of fixture 10 and fixture support 20 to provide rigid support for plugs 12 and 5 respectively.

To ensure proper alignment of plugs 12 and 5 during insertion of fixture 10 into fixture support 20, at least one groove 16 defined by the outer surface of trunk 11 and extending along its length may be provided. Corresponding guide pin(s) 2 on the inner surface of trunk 3 engages said groove 16 during insertion of fixture 10 into support 20, thereby restricting rotation of fixture 10 relative to fixture support 20, ensuring proper mating of plugs 12 and 5. As would be apparent to anyone skilled in the art, placement of groove and guide pin may be reversed with the same result.

To further assist in alignment of fixture 10 during insertion into fixture support 20, at least one guide post 8 may be provided on flange 9. During insertion, guide post passes through hole 17 defined by flange 13 and outlet cover 15, restricting rotation of fixture 10 relative to fixture support 20. Guide post(s) 8 may be threaded to permit fasteners to secure fixture 10 to fixture support 20.

Flanges 13 and 9 may be made of PVC material. Insulating rings 18 such as foam rubber may be disposed between outlet cover 15 and flange 13, and between flanges 13 and 9. Said rings providing a secure, weather-tight fit between flange surfaces and with outlet cover.

The modular system in FIG. 1 is shown assembled and installed on a surface such as a wall 30. A hole of sufficient diameter is drilled into the wall to receive trunk 3 of fixture support 20. Wire 7 is connected to house wiring already in the wall thereby energizing plug 5. Fixture support 20 is affixed to the wall with fasteners 6.

Electrical device(s) 21 are mounted to outlet cover 15. It will be recognized by one skilled in the art that various industry standard outlet covers are adapted to receive different types and numbers of electrical devices such as light fixtures and motion sensors, the one illustrated having threaded holes 22 to receive and secure said devices. Wiring 23 from plug 12 in fixture 10 passes from the interior of fixture 10 through outlet cover 15 to electrical devices 21, establishing electrical contact between said electrical devices and plug 12.

Thus, when fixture 10 is "plugged into" fixture support 20, the devices attached to fixture 100 are energized. Furthermore, the fixture can be easily "unplugged" to allow repair or replacement of electrical devices without exposure to risk of shock. Additionally, devices can thus be easily removed from one support and plugged into another without altering wiring 23.

Figure 2:
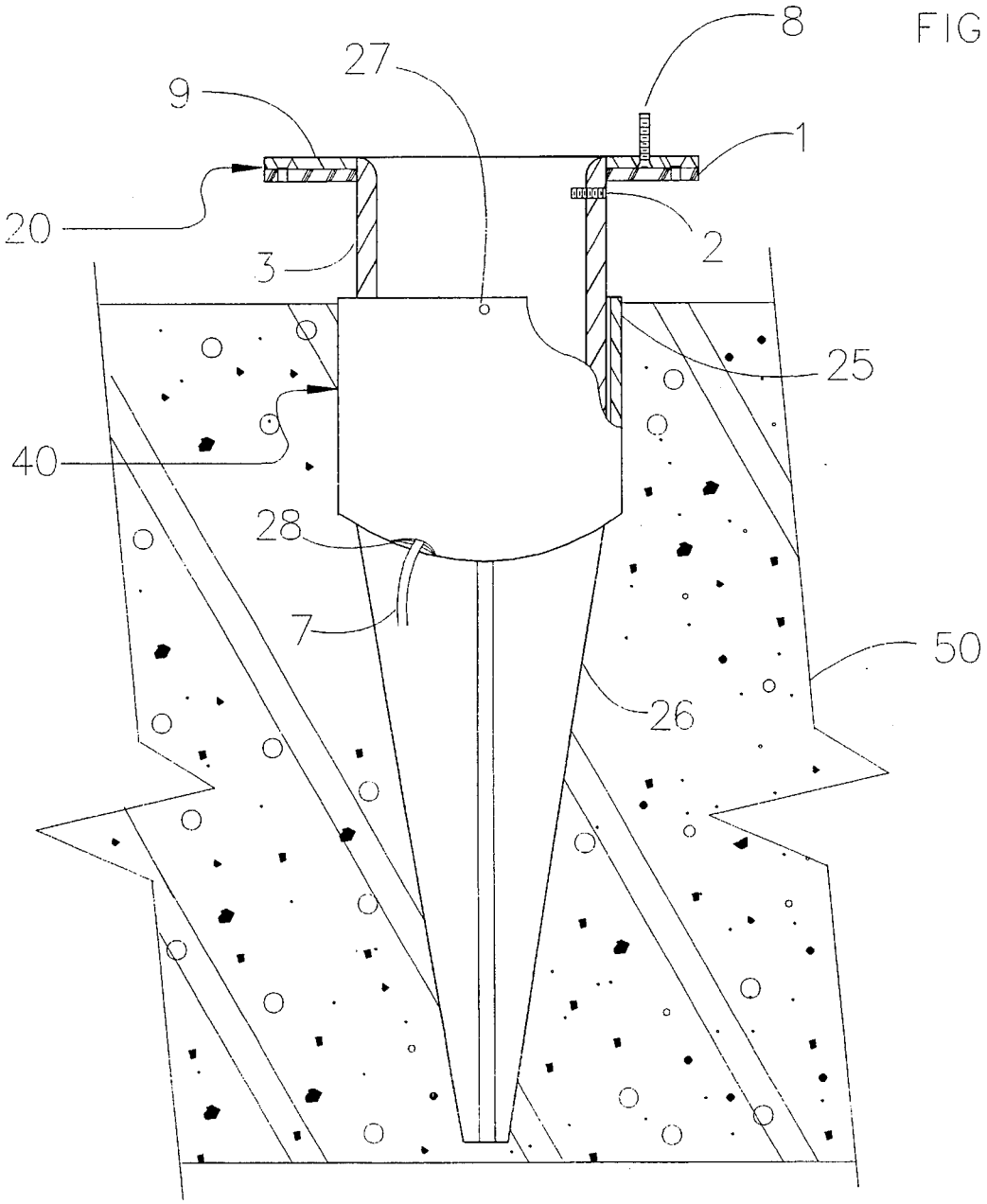
FIG. 2 is a section view of the modular fixture of FIG. 1 with a stake mounted in the ground.

Turning now to FIG. 2, the modular system is shown with post 40 installed into the ground. Post 40 comprises from top to bottom, a mounting cap 25 and a stake 26. The bottom of stake 40 is excavated into soil 50 or similar outdoor medium. Mounting cap 25 is attached to the top of stake 26 and is adapted to receive the rear of fixture support 20, thus securing it to the ground.

Stake 26 may be made of PVC. The length of stake 26 must be sufficient to provide relatively rigid support for the modular system. One foot is suitable for most outdoor locations.

Mounting cap 25 may be a PVC end cap, with a diameter sufficient to receive a portion of trunk 3. Mounting cap may be provided with one or more set screws 27 to lock fixture support 20 in place within the mounting cap. In order to allow electrical wire 7 to pass through the mounting cap, the cap may additionally be provided with a hole 28 which may be threaded to receive industry standard conduit or connector. When electricity is provided to the modular system as mounted on post 40, the modular system provides substantially the same advantages when installed in the ground as it does when mounted in a wall as described above.

Figure 3:
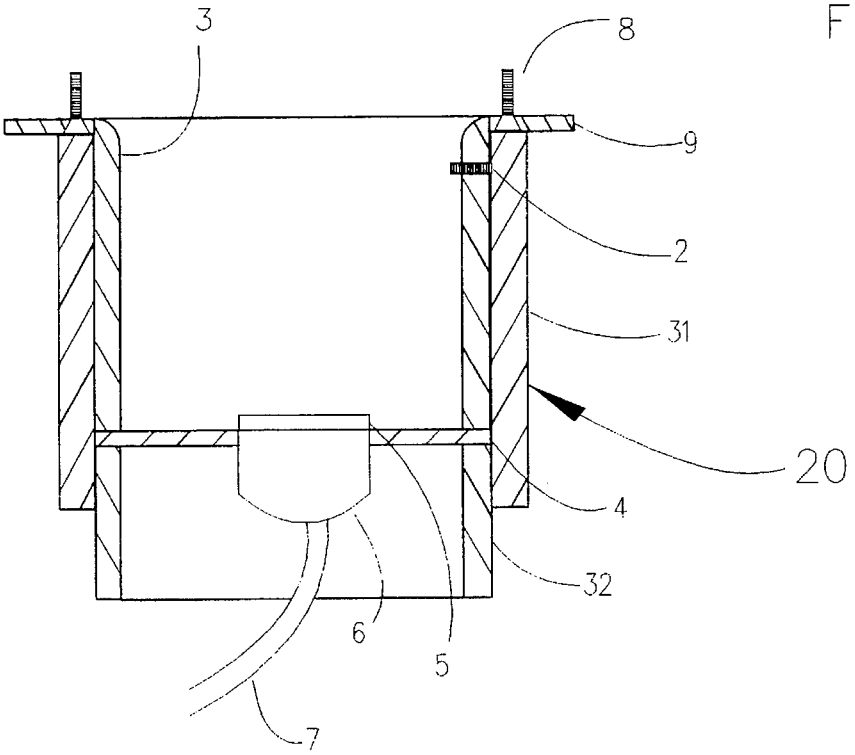
FIG. 3 is a section view of an alternate embodiment of fixture support of FIG. 1.

FIG. 3 illustrates an alternate embodiment of fixture support 20 wherein it is housed within an enclosure. The front of trunk 31 is affixed to flange 9. Annular collar 32 is affixed to the rear of cap 4 such that a shoulder is created at the rear of the assembly. Said shoulder should be adequate to permit secure mounting to post 40; a shoulder length of 1 inch is adequate for this purpose.

Trunk 31 may be made of PVC material. When trunk 3 is schedule 40 PVC pipe of 2 ½ inches, similar pipe with inner diameter of at least 2 ½ inches is appropriate for trunk 31. Collar 32 may also be made of PVC. When housed as shown in FIG. 3, fixture support 20 is given additional stability and protection from the elements, especially when mounted in outdoor locations. It will be understood that many combinations of materials will achieve a similar result when used as described above.

Figure 4:
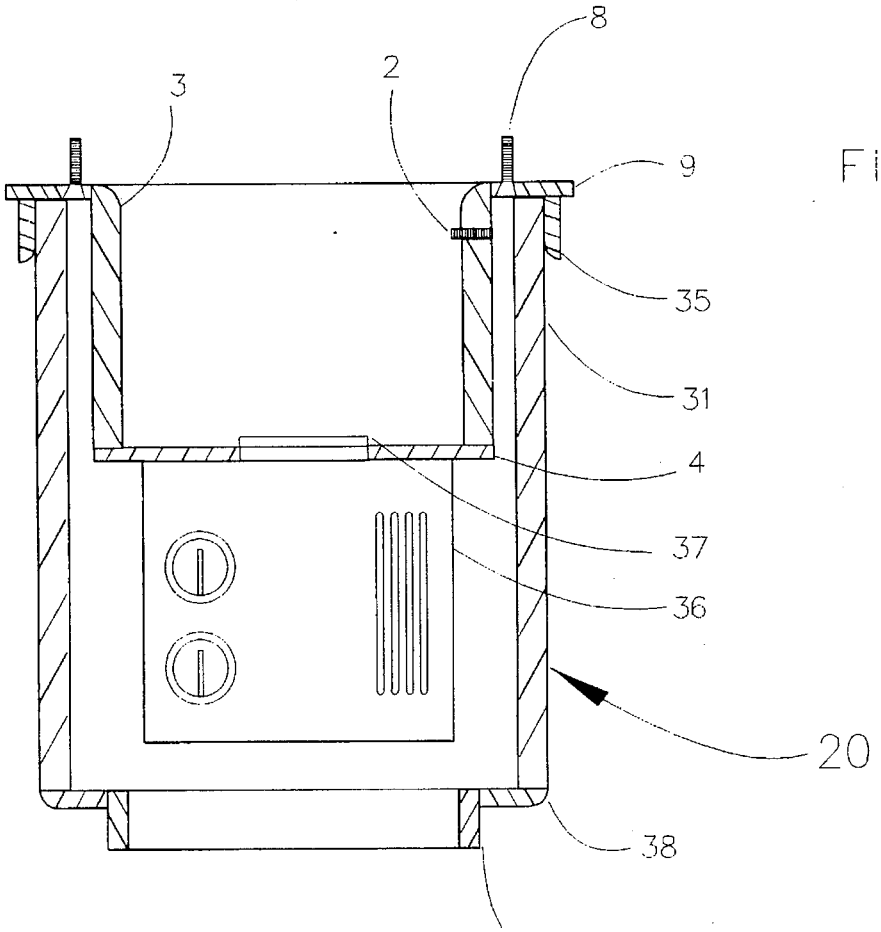
FIG. 4 is a section view of an alternate embodiment of fixture support of FIG. 1.

FIG. 4 illustrates fixture support 20 with a housing similar to that shown in FIG. 3 and described above, with the addition of annular ring 35 and remote control device 36. Ring 35 is affixed to the rear of flange 9. The front of trunk 31 is held in place against flange 9 by friction with ring 35.

Remote control devices are well known and widely used in home and industrial lighting applications. The specific type in use here is a Lightmaker of the Stanley Corporation. Control device 36 has on one side a female plug 37 to which electrical devices may be connected. Device 36 is affixed to the rear of cap 4 on fixture support 20. Device 36 is oriented so that said female plug 37 is facing forward and is aligned similarly to plug 5 as described in FIG. 1. Trunk 31 must be long enough to house both trunk 3 and device 36 attached to the rear thereto.

When device 36 is connected to a source of electricity, the system will provide remote switching of electrical device(s) 21 as shown in FIG. 1. It will be understood, however, that many methods of switching, both remote and local are possible and may be incorporated into the system without affecting the advantages of its modular design. Furthermore, because trunk 31 is held in place by friction only, easy access to control 36 is possible should it need adjustment or repair.

While several embodiments of the present invention are described herein, it would be understood by one of ordinary skill in the art that the various features of the several embodiments described herein can be used singly or in a variety of combinations depending upon the desired application. Therefore, this invention is not to be limited only to the embodiments specifically described herein, but instead it is considered to include all those embodiments falling within the scope of the appended claims.

I claim:

1. A modular system for mounting an electrical device having mounting means operable for engagement for securing said device in a predetermined location comprising:

a modular fixture member having a first base at one end and a first head at the other end, said first head being configured to engage said mounting means; and a fixture support member having a second base at one end and a second head at the other end, said second head configured for removable engagement with said first base; and first electrical plug means provided on base of said fixture member and operable for engagement with an electrical source to operate said electrical device; and second electrical plug means provided on said fixture support member for engaging said first electrical plug means when said modular fixture member engages said fixture support member, said second electrical plug means being operable for being connected to an electrical power source.

2. The mounting system of claim 1 wherein said first head has an outlet cover mounted thereon, said outlet cover configured for receiving and securing one or more electrical devices.

3. A modular system for mounting electrical devices comprising:

a modular fixture having a tubular body with a base at one end and a head at the other end, said head configured to securely receive one or more electrical devices; and a fixture support having a tubular body with a base at one end and a head at the other end, said tubular body having a cross-sectional shape corresponding to the cross-sectional shape of said fixture member and of a dimension, at the head of the fixture support member, sufficient to receive the base of fixture member for removable engagement therewith; and electrical plug means provided on base of said fixture member, corresponding electrical plug means provided upon a corresponding surface of said fixture support member for electrically interconnecting fixture member with fixture support member while fixture member is engaged therewith; and means for electrically connecting electrical devices to said fixture member and providing electrical energy thereto.

4. The mounting system of claim 3 wherein a flange is provided at the head of said fixture member; and a flange is provided at the head of said fixture support member.

5. The mounting system of claim 4 wherein one or more posts attached to one flange are aligned to pass through portions of the other flange defining a hole, during engagement of said fixture and fixture support members, to facilitate alignment of said members with respect to one another.

6. The mounting system of claim 5 wherein said posts are further adapted to receive fasteners, to secure said fixture member while engaged with said fixture support member.

7. The mounting system of claim 4 wherein said flanges have disposed, on the surfaces thereof, an insulative, resilient material.

8. The mounting system of claim 4 wherein said flange provided on said fixture support member has at least one hole provided therein to receive fasteners therethrough to permit mounting of the fixture support member in a wall.

9. The mounting system of claim 3 wherein the outer surface of the tubular body of said fixture member has provided therein at least one groove extending along the length of the fixture; and a corresponding number of guide pins is provided on the inner surface of the tubular body of said fixture support member, said pin(s) positioned to follow said groove and prevent rotation of fixture relative to fixture support during engagement thereof.

10. The mounting system of claim 3 wherein a cap is provided at the base of said fixture member and at the base of said fixture support member to provide a rigid mounting surface respectively for said electrical plug means.

11. The mounting system of claim 3 further comprising means for supporting said fixture support member in the ground.

12. The mounting system of claim 11 wherein said support means comprises a stake having a first end, disposed in the ground, and a second end adapted to securely receive base of said fixture support member.

13. The mounting system of claim 3 further comprising a control means for regulating flow of electrical energy to said electrical devices.

14. The mounting system of claim 3 wherein body of said fixture member and said fixture support member are formed of polyvinyl chloride.

15. The mounting system of claim 3 wherein head of said fixture member has an outlet cover mounted thereon, said outlet cover configured for receiving and securing one or more electrical devices.

* * * * *